US005407537A

United States Patent [19]

Malatesta et al.

[11] Patent Number: 5,407,537

[45] Date of Patent: Apr. 18, 1995

[54] PROCESS FOR SIZING PAPER AND SIMILAR PRODUCTS

[75] Inventors: Alberto Malatesta, Brussels, Belgium; Christian Pierre; Rene Cohard, both of S.-Martin-d'Heres, France

[73] Assignee: Exxon Chemical Patents Inc, Linden, N.J.

[21] Appl. No.: 238,587

[22] Filed: May 5, 1994

Related U.S. Application Data

[63] Continuation of Ser. No. 910,337, Sep. 21, 1992, abandoned.

[30] Foreign Application Priority Data

| | | | |
|---|---|---|---|
| Jan. 22, 1990 | [GB] | United Kingdom | 9001436 |
| Jan. 22, 1990 | [GB] | United Kingdom | 9001437 |
| Apr. 12, 1990 | [GB] | United Kingdom | 9008334 |
| Apr. 12, 1990 | [GB] | United Kingdom | 9008335 |

[51] Int. Cl.[6] ..... D21H 23/02

[52] U.S. Cl. ..... 162/158; 162/175; 162/183; 162/179; 162/322

[58] Field of Search ..... 162/158, 175, 183, 184, 162/185, 186, 322, 179

[56] References Cited

FOREIGN PATENT DOCUMENTS 696673 9/1953 United Kingdom ..... 162/140

*Primary Examiner*—Peter Chin
*Attorney, Agent, or Firm*—John J. Mahon

[57] ABSTRACT

Size dispersion in paper stock is improved by treatment of cellulose water slurry with cationizing compounds and mixing a sizing product, either neat or in solution, with the water and injecting the mixture in droplet form into said cellulose water slurry before, during or after the paper web formation whether said paper web is dry or not and drying the paper web, an apparatus for carrying out the improved process is included.

29 Claims, 2 Drawing Sheets

PROCESS FOR SIZING PAPER AND SIMILAR PRODUCTS

This is a continuation of application Ser. No. 07/910,337 filed on Sept. 21, 1992, abandoned.

This invention relates to a process and apparatus for sizing paper or similar products, such as board, cardboard etc., based on cellulose or synthetic fibres. Particularly paper produced under alkaline or neutral conditions using cyclic acids anhydrides, especially alkyl or alkenyl succinic anhydrides (ASA), alkyl ketene dimers (AKD), or their mixtures as sizes.

Paper, board, cardboard and other similar products are produced by first dispersing the cellulose or synthetic fibres in large quantities of water and the dispersion passed to a paper making machine where the water is removed to form the continuous paper web.

According to the nature of the fibres, the type of paper or board to be produced etc., the product is treated with various chemicals which may be injected into the aqueous dispersion of the fibres. One particular treatment common to most paper making processes is sizing.

Sizing of paper is well known, two typical sizing materials are alkyl-ketene dimers and alkenyl succinic anhydrides. These products are generally used in emulsion form as described in, for example, Japanese Patent Publications 62-231099; 61-146898; 61-160495; 52-25102; 60-20905. Whilst the present invention is concerned with sizing in general it is particularly concerned with sizing with alkenyl succinic anhydrides.

United Kingdom Patent 1492104 describes the use of polyoxyalkylene alkyl or arylalkyl ethers, or the corresponding mono- and di-ester derivatives to produce emulsions of cyclic acid anhydrides with a low input of shear energy. Such emulsions are used to disperse intimately the anhydrides into the cellulose stock to produce sized paper. The sizing emulsion can be produced in-situ, within the cellulose stock, or prior to introduction into the cellulose stock. The emulsions are preferably prepared in the presence of cationised stabilisers such as cationized starches, polyaminoethyl acrylate resins, polyamide resins having free amino groups, reacted or not with epichlorohydrin etc.

The main function of these cationic stabilizers is to charge positively the emulsion's particles favouring their absorption by Coulombic attraction on the negatively charged surface of the cellulose fibres.

The use of nitrogen and/or oxygen containing emulsifiers to produce emulsions of cyclic acid anhydride emulsions, in the presence of cationic stabilizers, with a low shear energy input is generally carried out using a concentration of 2.0 to 10.0% emulsifier based on the anhydride. Concurrently, typically 1 to 5 parts of cationic stabilizers are used for 1 part of anhydride.

The emulsions obtained are chemically unstable in water. As a consequence, emulsion particles with submicron diameters are quickly hydrolysed. On the contrary, emulsions particles of diameter above 3–4 microns, with too low surface-to-mass ratios lack enough Coulombic attraction to be rapidly deposited onto the cellulose and thus remain suspended in the process water used in the paper making.

Consequently, they are recycled continuously with the process water and are eventually hydrolysed which not only wastes sizing compounds, but causes paper machine running problems. The emulsion-based sizing technology further produces poorly sized paper due to re-wetting phenomena, caused by the emulsifier, low sizing yields and foaming.

Re-wetting results from the presence of residual emulsifier in the cyclic acid anhydride absorbed on the cellulose fiber's surface. The emulsifier's polar groups, spread over the surface of the anhydride particle, attract water to the surface thus favouring the anhydride hydrolysis rather than its reaction with the hydroxy groups in the cellulose.

Moreover, the presence of residual emulsifier on the finished paper creates undesirable water affinity in the paper and the consequent decrease of the hydrophobic character of the paper produced by sizing. These difficulties are not eliminated by reducing the emulsifier concentration to below 1.0% based on the anhydride and by using high shear mixers in the presence of 1 to 5 parts of a cationic stabilizer for 1 part anhydride. Even by using turbine-type mixers (rotating in the range 10000 to 20000 RPM) it is difficult to control the particle's diameter distribution both in the sub-micron and 3 to 4 micron ranges. The anhydride molecular weight and the structure of its alkenyl chain have little influence on the above behaviour.

High-shear emulsification techniques based on turbine pumps with inlet-outlet pressure drops as high as 8 to 10 kg/cm$^2$ are needed to obtain emulsion particle diameter distributions for best sizing result. However, the high-shear produced emulsions are characterized by poor stability and they tend to phase out quickly.

Producing paper, with the use of cyclic acid anhydride emulsions for sizing, requires some additional skills not generally available to the paper industry and extra caution. Also, operational costs are higher and foaming can cause problems.

Foam, with its large air-liquid interface, favours evaporation of the recycle liquids with the formation of fatty deposits both on the paper and in the water recycle tank. These can also cause paper machine running problems. Thus, more frequent cleaning operations may be needed which tend to disrupt the process and to increase the production costs. A further negative cost item is represented by the use of the emulsion's cationic stabilizers.

A number of problems encountered by the paper industry when using emulsions of cyclic acid anhydrides in sizing paper are described in:

1987 Sizing Short Course, Apr. 8–10 1987, Atlanta, Ga., TAPPI Press 1987.

Alkaline Papermaking, Apr. 17–19, 1985, Denver, Colo., TAPPI Press 1985, ISSN 0738-1190.

Thus, although sizing paper may be achieved by using emulsified reactive synthetic products, the disadvantages are sizing compound waste due to hydrolysis, poorly sized paper due to re-wetting phenomena, low sizing yields, foaming, fatty deposits formation in the water recycle tank and paper machine running problems.

In addition paper production processes based on sizing with emulsified products is less economic due to:

the need for emulsifiers and emulsion stabilizers.

a larger use of sizing compounds to compensate for the lower sizing yields, resulting from the size's hydrolysis, and the ensuing lower hydrophobic character of the paper.

the need for more frequent cleaning operations leading to an increased number of process disruptions.

the need for high-shear turbine pumps or static, high pressure differential, static mixers.

It is the main purpose of this invention to reduce or eliminate the technical and cost problems associated with the paper sizing with emulsified sizing compounds especially those based on cyclic acid anhydrides.

An aim of this invention is to develop a method to interact the sizing compounds with the cellulose stock in the absence of an emulsifier which predetermines accurately and with reproducibility the contact time and the sizing compound's particle diameter as a function of other relevant process parameters (for instance, type of cellulose, paper stock degree of freeness, type of mineral charges, temperature of the drying section, etc.).

Another aim is to develop a method, to contact the synthetic sizing compound with the cellulose stock which reduces hydrolysis of the sizing compound during its residence period in the process water.

Yet another aim is to produce paper with an acceptable hydrophobicity for writing and printing as indicated by the standard tests developed for the paper industry such as the Hercules Size Test and the Cobb Test.

It is also desirable that the method to contact the synthetic sizing compound with the cellulose stock be readily adaptable to existing plants producing paper, cardboard, etc.

In our European Application 89306178.8 we describe a process for the production of paper, board, cardboard, etc., with a sizing process comprised of the following steps:

production of a cellulose stock water slurry.

cationization of such slurry.

dispersing the synthetic size, neat or in solution with non active compounds such as gases or solvents, in form of fine droplets into the cellulose stock before, during or after the paperweb formation whether or not said paperweb is dry or wet.

drying the paperweb.

As this technology has been developed to commercial scale we have found that the process may be improved if the size is injected by means of a piston pump through one or more nozzles immersed in the aqueous system. We also find that the dispersion of the size is improved if it is preheated before injection into the cellulose stock/water slurry. As a preferred feature of the invention the size is mixed into a small amount of water prior to injection into the cellulose stock/water slurry. This stream of water may contain cationised starch and/or other cationizing agents such as proteins, polyamines as well as natural gums and synthetic polyhydroxylated hydrocarbons.

Accordingly the present invention provides a process to size paper and similar products comprising:

forming a cellulose water slurry;

preheating a sizing product, either neat or in solution, mixing the preheated sizing product with water and injecting the mixture in droplet form into said cellulose water slurry before, during or after the-paper web formation;

wherein the cellulose water slurry and/or the size is treated with a cationizing compound.

drying the paper web

The preferred temperature to which the size should be preheated depends upon the nature of the size, where alkenyl succinic anhydrides are used the temperature should be from 30° to 65° C. preferably 35° to 50° C., where alkyl ketene dimers are used the temperature should be above their melting point, generally above 40° C. We also prefer that the water into which the preheated size is mixed be heated to a temperature in the range 30°–65° C.

When the slurry is cationized it is generally treated with mineral charges after mixing with the size.

Further benefits of the use of the process of the invention will become apparent in the detailed description of some procedures needed to implement it. Such procedures are described to explain the invention and are not meant to be a limitation thereof.

Figure 1:
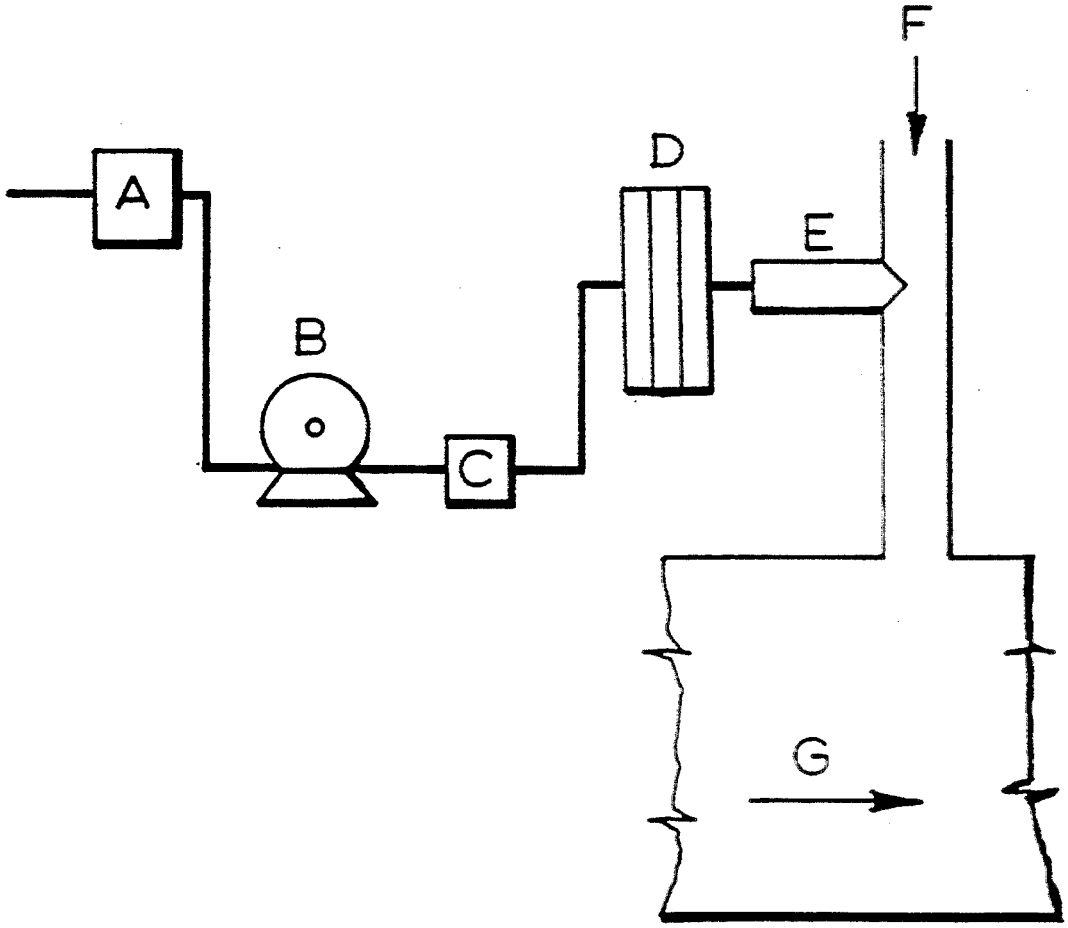
FIG. 1 shows the injection system of the present invention.

According to the preferred procedure to implement the invention, the reactive synthetic sizing compound mixed with water is continuously dispersed in the form of fine droplets into the wet-end of the paper machine, preferably in places where the cellulose stock water slurry is under high turbulence, to obtain rapid and complete contact of the sizing compound with the paper stock.

The sizing compound dispersion is conveniently obtained with a spraying nozzle, which produces droplets in the water of predetermined dimensions and a predetermined particle diameter distribution. The spraying nozzle type and spraying angle may change depending on the type of paper machine and on the place, within the paper machine, where it will be positioned for best result. The number of spraying nozzles used may be chosen according to the type of paper machine and the type of paper or paper product being manufactured.

We have found that good dispersion of the size into the large aqueous systems may be achieved by pumping the size with a piston pump through one or more nozzles immersed in the aqueous system.

Spray-mixing will then occur due to the large-pressure differential created at the nozzle tip between the size and the paper stock. Such differential accelerates the disintegration of the liquid jet, issuing at high speed from the nozzle tip, into small spherical particles by impingement on the surrounding fluid.

The reactive synthetic sizing compound may be delivered to the spraying nozzle through a pressurized piping system and the spraying pressure can be generated with metering micro-pumps. Alternatively, the compound may be delivered to the spraying nozzle from storage tanks which are pressurized with an inert dry gas, and the compound can be metered with calibrated microvalves.

The storage tanks, the piping system, the nozzles, the valves and the metering micro-pumps can conveniently be thermostated to maintain the size at the desired preheating temperature. Convient thermostating may be achieved with water at the selected temperature.

Thermostating controls the viscosity of the sizing compound and produces droplets with predetermined diameters when exiting the spraying nozzle. The viscosity control which is especially useful when reactive sizing compounds which are solid or highly viscous at room temperature, are used. For instance, this could be the case with cyclic anhydrides substituted with palmityl (or heavier) or linear rather than branched groups or the use of alkyl ketene dimers.

In the preferred process the preheated size is injected into a stream of water at substantially the same temperature as the size shortly before the stream of water is itself injected into the bulk cellulose stock. This water stream can also be used to introduce other additives into the paper stock such as defoamers, proteins, natural gums, synthetic polyhydroxylated hydrocarbons, alum and cationic starch. Products to micro-encapsulate the size and thus inhibit its hydrolysis may also be included in the water.

The sizing product pressurization in the storage tank can be obtained, at or about room temperature, with dried gases such as air, nitrogen, argon, methane, propane, butane, chlorofluoro hydrocarbons, carbon dioxide, nitrogen protoxide. Some of said gases are soluble in the reactive sizing compounds at the storage temperature.

The absorption of the sizing compound droplets on the cellulosic fibres is aided by the cationizing treatment. The fibres may have undergone previous cationization either on-line or in the paper stock preparation tubs. Alternatively the size itself may be applied together with the cationizing agent. Such cationization is a standard technique in paper production to favour the retention of wet-strength resins, of mineral charges, etc., which otherwise would be in large part lost. The cationization is generally carried out with long chain fatty amines, synthetic polymers containing amines, cationic modified starches, polyamide-amine resins and other cationized products. Typically 0.02 to 3.50 wt % of cationizing agent based on the weight of dry fibre is used.

The time of contact between the process water and the reactive synthetic sizing compound in dispersed droplet form is very small, depending on the turbulence of the machine wet-end and on the cationizing treatment. These factors can be varied to obtain the desired deposition rates of the size droplets on the fibres.

The combined action of the extremely low contact time with the process water and the natural hydrophobicity of the sizing compound prevent its hydrolytic degradation and the resulting waste.

Moreover, by lowering the droplets diameter the interactions with the cellulose fibres and the sizing compound absorption can be improved thus increasing the sizing yield to a level beyond that achieved with the current emulsion technology.

In another procedure to implement this invention, solutions of certain gases, such as methane, propane, butane, chlorofluoro hydrocarbons, carbon dioxide, etc., in the synthetic sizing compound are sprayed in form of fine droplets directly into the wet-end of the paper machine or onto the formed paper web before the machine drying section, or in the size press.

The nozzle(s), or any similar device, connected with a pressurized piping system to the storage tank containing the sizing compound solution, may be used to disperse the sizing compound solutions into the cellulose-water slurry. Preferably the injection system is controlled by the rate of paper production and consists of a preheated vessel which feeds a low pressure feed pump which itself feeds, preferably through a filter, a metering pump which is conveniently a 4 to 6 cylinder metering pump operating at pressures in the range 50 to 300 atmospheres, preferably 120 to 200 atmospheres, the pump being controlled by a signal from the paper stock flow to maintain constant the ratio of size to stock.

The pump injects the size through one or more nozzles into the water stream and hence into the stock at the determined rate to give appropriate sizing. Any gas evaporates or it is dissolved by the process water, favouring the droplets dispersion without affecting in any other way the paper production process.

Another important function of the dissolved gas is to protect the surface of the droplets from water's hydrolytic action, and to produce in-situ a fresh surface on the droplets as the gas evaporates or dissolves into the process water.

A range of gas sizing compound mixtures may be used, the preferred composition may depend from the type of paper produced in a given machine and from the process parameters.

In general, the dissolved gas concentration may be in the range 20 to 50% on the sizing compound although for economic reasons it is preferable that gas concentrations be kept in the range 1 to 19%. The sizing compound gas solutions could also be obtained by previously mixing gas types with low and high solubility into the sizing compound, such as nitrogen and carbon dioxide, nitrogen and methane.

In another procedure, the reactive synthetic sizing compound is first dissolved in an anhydrous, aprotic, water-soluble, inert solvent. The solution, is sprayed with one or more nozzles as fine droplets directly into the water-cellulose slurry at the paper machine wet-end. In this case, the inert solvent is dissolved by the process water thus protecting the reactive sizing compound droplets from water's-hydrolytic action and generating in-situ a fresh surface in the presence of cellulose.

As a further embodiment inert gases may be dissolved in the aprotic solvent, as previously specified (for example carbon dioxide).

Examples of useful aprotic compounds include ketones, esters, ethers, aromatic and aliphatic hydrocarbons, (for example acetone, methylethyl ketone, acetonyl acetone, methyl acetate, ethylene glycol diacetate, dioxane, etc.). A range of solvent concentrations in the solutions with the sizing compound can be considered.

The preferred composition will be determined by experiment depending on the process parameters. Cost considerations would indicate that solvent concentrations in the range 1 to 19% may be preferred to concentrations in the range 20 to 50% or higher, use of these lower concentrations will also avoid solvent accumulation in the water recycle system.

In another preferred procedure to implement the invention, the reactive sizing compound is dissolved in an anhydrous, protic, water soluble compound immediately before being sprayed and transformed in fine droplets.

Preferred concentrations of the protic anhydrous solvent with the reactive sizing compound are as previously disclosed in the case of the aprotic solvents. Classes of such solvents include alcohols, etheralcohols, esteralcohols (e.g. methyl alcohol, ethyl alcohol, 2-butoxyethanol, ethylene glycol monoacetate, 2-(2 butoxyethanol), etc.

0.005 to 2.0% weight of size on dry fibres is preferably used. Subsequent to application of the size, the paper web is dried by heating to temperatures in the range 90° to 120° C. which also promotes the reaction between the reactive sizing compound and the hydroxyl groups of the cellulose.

This may be performed by the heated cylinders which provide also the pressure needed to impregnate the paper web with the reactive sizing compound.

According to an alternative procedure to implement the invention, the synthetic sizing compound is sprayed onto the formed paperweb with one or more nozzles having small spraying angles. They could spray in the direction of one side of the paperweb, or in the opposite side or on both sides simultaneously.

With this technique, the spraying can be extended to the whole surface of the paperweb or can be limited to some parts of the surface, either when still wet or in a size press, or in both positions.

When spraying in a size press, the final drying cylinders used to dry the paper should exert enough pressure and reach a temperature high enough to ensure both the impregnation by the sizing compound of the paper wet thickness and the reaction with the hydroxyl groups of the cellulose.

When the sizing compound is applied in the size press, its concentration could reach values above 2% weight on dry fibres. Higher concentrations are possible with consequences on the cost.

A certain period of time will be required to achieve such reaction when the sizing compound concentration is in the higher ranges.

The preferred synthetic reactive sizing compounds are cyclic acid anhydrides of the general formula

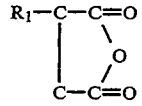

where $R_1$ is an organic hydrophobic group. More preferred are the liquid cyclic acid anhydrides in which $R_1$ is a branched chain $C_8$–$C_{16}$ alkenyl group.

Typical examples of cellulose that may be treated with the sizing compounds are derived from hardwoods and softwoods, bleached or not bleached, semi-chemical, groundwood and combination thereof. Synthetic rayon or regenerated cellulose fibres may also be used as well as waste paper and cardboard.

The present invention may be applied to any sizing material examples of which include acyl halides, cyclic acid anhydrides, alkyl ketene dimers, isocyanates, alkyl amino chlorides, urea derivatives, carbonic acid chlorides, chlorosulphonic and chlorophosphoric acid amides such as those described in the 1987 Sizing Short Course Reference mentioned above.

Alternatively mixtures of sizing materials may be used. Where the materials are solids at room temperature, such as alkyl ketene dimers, it may be necessary to apply them as solutions or in the molten state, or as mixtures with other sizing compounds in which case the preheating temperature should be such that the product is either molten or in its liquid state.

An injection system which also forms part of the present invention is illustrated schematically in FIG. 1 which shows the size being fed from storage to a preheater A from which it is fed to a low pressure pump B through filter C to the metering pump D which forces the size through the injector nozzle E into a pipe F through which a water stream flows into the main Cellulose stock G.

The operation of the low pressure pump is preferably controlled by the rate of paper production as is the operation of the metering pump to control the ratio of size that is applied to the stock.

Figure 2:
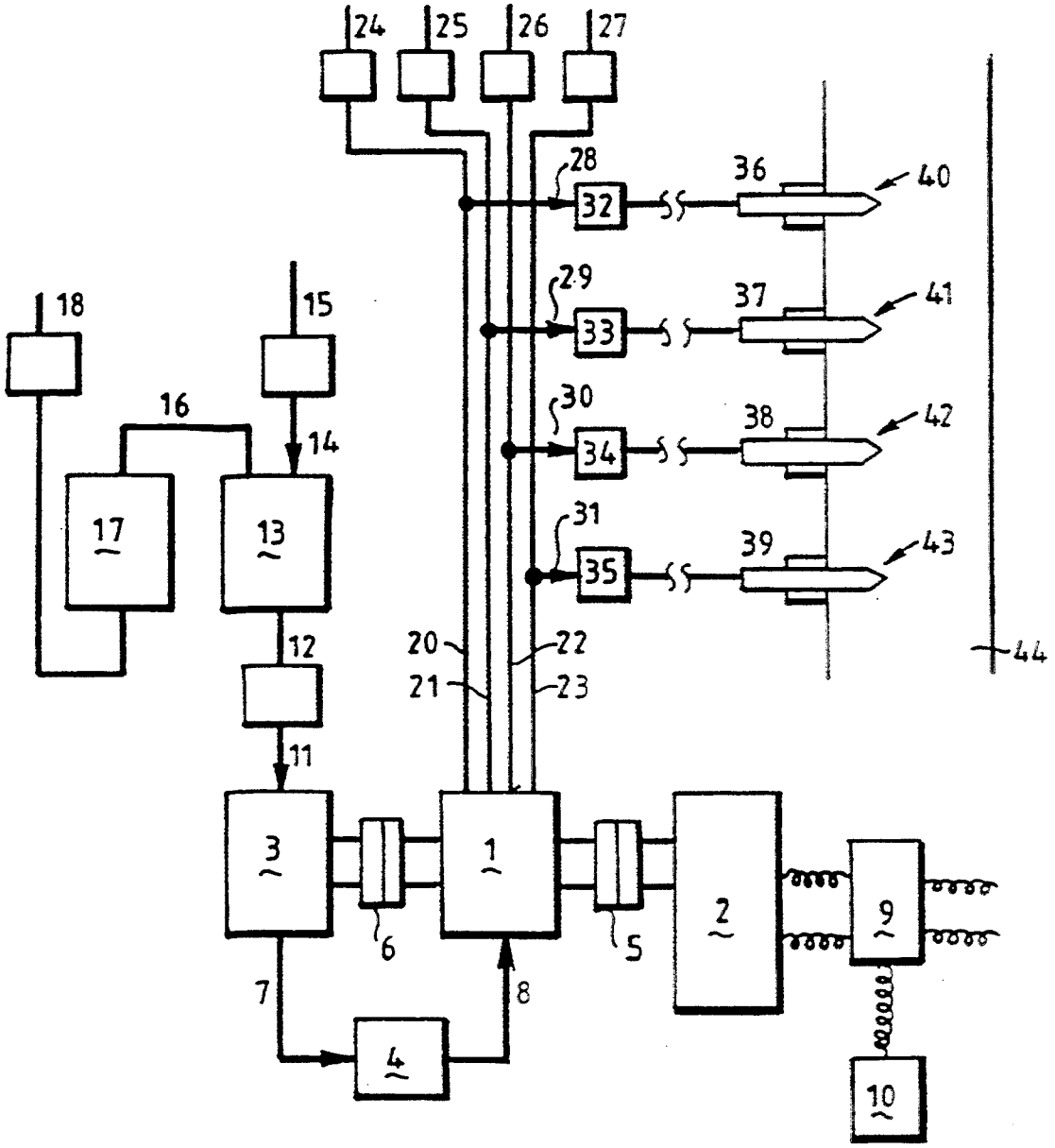
FIG. 2 shows a more detailed and preferred embodiment of the injection system of the present invention.

A more detailed and preferred embodiment of the invention is illustrated by reference to FIG. 2. The size is injected through a spray-mixing device which comprises a four barrel pump, 1 connected to the axle of a variable speed electric motor, 2 with camshaft 5. Pump 1 can comprise any number of barrels depending on the application. Low pressure pump 3 is connected by camshaft 6 to pump 1 and through filter 4 by pipes 7 and 8 to pipe 11. It feeds liquids or melts, filtered from solid impurities, to the 1 suction side of pump 1. Pump 3 is connected by pipe 11 to tank 13 where the size is stored. The pump's barrels are connected with pipes 20, 21, 22, 23 to pressure release safety valves 24, 25, 26 and 27.

Pump 1 delivers the size under pressure to nozzles 40, 41, 42, 43 with pipes 28, 29, 30, 31. The nozzles are fixed on pipe 44 with nozzle holders 36, 37, 28 and 39.

The device is operated in the following way. Tank 13 is filled through pipe 14 with the liquid to be mixed to water and watery fluids flowing in pipe 44. Valve 15 is then closed. Tank 13 is connected with pipe 16 to tank 17 containing silica gel, molecular sieves and similar air drying agents. Tank 17 is connected to the atmosphere when valve 18 is open.

Opening valve 12 on pipe 11 thus connecting tank 13 to piston pump 1 through low pressure pump 3, pipe 7, filter 4 and pipe 8, lets the size flow into the pump's barrels. Closing valves 32, 33, 34, 35, hand-rotating camshaft 5 and opening pressure release safety valves 24, 25, 26, 27 facilitates filling the barrels.

Starting-up electric motor 2, opening valves 32, 33, 34, 35 and closing safety valves 24, 25, 26 and 27 initiate metering and spray-mixing the size into pipe 44 (containing water or watery fluids flowing therein) through nozzles 40, 41, 42, 43 fixed on pipe 44 with nozzles 36, 37, 38, 39, 40. We have found that pintle nozzles such as those used for the injection of diesel fuel into diesel motors are particularly useful.

Safety release valves 24, 25, 26, and 27 connected to the pump's barrels with pipes 20, 21, 22, 23 and to nozzles 40, 41, 42, 43 with pipes 28, 29, 30, 31, will open when the pressure in the system will increase above a safe set value.

In the preferred embodiment of the invention, the size is spray-mixed into flowing water or watery liquids in pipes, similar to 44, to which the nozzles are fized in any preferred position (for instances, all nozzles in a row along the pipe length or spaced around the pipe diameter with preferred angles etc.). The number of nozzles to be utilized is at will depending upon the volumes of liquid to be spray-mixed, the number of barrels of the pump used and the number of pumps.

In the preferred embodiment of the invention, pumps 1 and 3, filter 4, valves 12, 24, 25, 26, 27, 32, 33, 34, 35, tank 13, pipes 8, 11, 20, 21, 22, 23, 28, 29, 30, 31 and nozzles 40, 41, 42, 43 are electrically heated to change the temperature and thermostating of the liquids contained in them. A temperature higher than ambient temperature may have beneficial effects on pumping and spray-mixing especially during winter operations or if strong mixing is performed with substances melting at temperatures in the range 20° to 100° C.

In the preferred embodiment of the invention, tank 13 may be weighed continuously to record the flow and to accurately meter the size.

The spray mix device can be constructed with low carbon steel, stainless steel or with other materials depending on the type of fluid being spray mixed. While pipes 20, 21, 22, 23, 28, 29, 30, 31 and valves 24, 25, 26, 27, 32, 33, 34, 35 need to resist to pressures in excess of 200 kg/cm$^2$, pipes 11, 7, 8 and filter 4 need to resist to only 3–10 kg/cm$^2$.

In the preferred embodiment of the invention, the speed of electric motor 2 is varied by means of an electronic connection to the circuitry of the pump which generates the flow of water or watery fluids in pipe 44. With this arrangement, positive or negative flow variations in pipe 44 will automatically modify pump 1 outputs.

The device previously described has been used to meter and spray-mix, at pressures in the range 100 to 250 kg/cm$^2$, $C_{12}$ and $C_{16-18}$ alkenyl succinic anhydrides (ASA) into paper pulp during paper making operations. Paper pulp to ASA ratios in the range 40,000 to 100,000 have been successfully demonstrated with a spray-mix pressure of 200 kg/cm$^2$ and with the production of Gaussian ASA dispersions having particle diameters centered around 1–2 microns.

The quality of the paper produced during such industrial runs indicated that its hydrophobic character, as determined by Cobb and ink penetration sizing tests, has been constant and in the range of accepted industrial and commercial standards.

The present invention is further illustrated by the following Examples in which the content of all materials refers to weights on dry cellulose. The following materials are used:

A) Bleached sulphate cellulose (60% hardwood, 40% softwood) of freeness 35.SR and concentration 40 g/liter in tap water (hardness 17 French degrees) is treated with 0 to 0.5% hydrated aluminium sulphate (alum) as a 100 g/liter solution in tap water.

B) Cationized potato starch (Roquette Fr. HICAT 180 brand), of concentration around 5% in demineralizewd water is cooked at 85°–90° C. for 30 minutes and subsequently diluted approximately 5 times. The starch is normally used within 12–24 hours from cooking to prevent unwanted ageing.

C) Calcium Carbonate (Craie Micronic O brand) is pre-slurried in tap water at the concentration 350 g/liter.

D) Alkenyl succinic anhydride (EXXON CHEMICAL CO), having a $C_{12}$ branched side chain, and FIBRAN 76 (Roquette Fr. brand), having a $C_{16-18}$ side chain, are used as sizing agents.

E) Polyacrylamide (Schimmer & Schwartz FO4550BPM brand), dissolved in water at the concentration 0.038%, is used as flocculating retention aid.

F) Sodium polysilicate $Na_2Si_3O_7$,.$3H_2O$ as a 42 wt % water solution is added without modifications. Colloidal polymerized silica containing 0.3% $Na_2O$ as a 15% water dispersion (EKA-KEMI Compozil BMA Brand) is added without modification.

G) Diethylene tetra amino pentamethylene phosphonic acid (MONSANTO DEQUEST 2060S) containing 0.1% $Na_2O$ as a 20% water solution.

EXAMPLE 1

An amount of a 0.25% alum-treated paper stock from bleached sulphate cellulose (60% hardwood, 40% softwood), is fed to a 5 m$^3$ feed tub and it is treated with 0.5% cooked cationic potato starch. The paper stock amount is limited to about 1 hour of machine feed to prevent unwanted ageing.

A piston metering pump connected to a spraying nozzle is used to spray-mix neat branched chain $C_{12}$ alkenyl succinic anhydride D preheated to 35° C. into a stream of tap water at 40°–50° C. and the mixture is fed at the rate of 0.5 m$^3$.Ton$^1$ to the suction side of the pump feeding the alum-treated paper stock to the paper machine.

The paper machine is constructed by SICMA, Terni, Italy. It is fitted with a Fourdrinier net width 0.56 m and a series of 22 steam-heated drying cylinders, running at the speed of 40 m.min$^{-1}$ and producing about 100 kg paper per hour. The grammage is kept at about 80–85 g.m$^2$.

25% calcium carbonate slurried in water is metered on-line into the paper stock on the suction side of the fan pump. The paper stock pH after calcium carbonate addition is in the range 7.2–7.6.

0.038% polyacrylamide E is finally added to the paper stock just before it enters the head box.

Sodium polysilicate F is metered on-line into the paperstock on the suction side of the fan pump together with calcium carbonate slurried in water. The paperstock pH after addition is in the range 7.2 to 7.6.

Runs 3 and 4 were carried out with a paperstock pretreated with 0.5% alum and Run 4 with 0.3% sizing agent concentration.

The following paper machine parameters are observed when equilibrium is attained.

| Run No. | 1 | 2 | 3 | 4 |
|---|---|---|---|---|
| Sodium polysilicate % | 0.08 | 0.16 | 0.08 | 0.08 |
| Size % | 0.25 | 0.25 | 0.25 | 0.30 |
| Head box paper stock concentration g.l$^{-1}$ | 3.6 | 3.6 | 3.6 | 3.6 |
| First pass retention all solids % | — | 95.0 | — | 96.6 |
| First pass retention calcium carbonate % | — | 91.1 | — | 93.8 |
| Ashes at 425° C. % | 22.4 | 21.6 | 22.5 | 22.0 |
| Zeta potential white waters mV | — | +4.4 | — | +5.3 |
| Felt + Wire/2 Cobb 60" (50% RH, 23° C.) | 21 | 21 | 19 | 20 |
| Grammage g.m$^2$ | 80 | 80 | 80 | 80 |

The paper web is dried in the machine drying section, whose steam-heated cylinders are programmed to reach temperatures in the range 50°–110° C., before being wound up.

The Cobb 60" results show that the paper is properly sized and has a commercially acceptable hydrophobicity for writing and printing.

EXAMPLE 2

Example 1 is repeated in Runs 5, 6, 7 and 8. Run 9 is carried out with FIBRAN 76 as sizing agent. In all cases, the size concentration is 0.256.

The Sodium polysilicate F is metered on-line into the paperstock on the suction side of the fan pump together with calcium carbonate slurried in water. The paperstock pH after addition is in the range 7.2 to 7.6. Runs 5 to 8 are carried out with decreasing amounts of polyacrylamide (from 0.038% as in Example 1 to 0.019 and 0.0%).

The following paper machine parameters are observed when equilibrium is attained.

| Run No. | 5 | 6 | 7 | 8 | 9 |
|---|---|---|---|---|---|
| SODIUM POLYSILICATE % | 0.67 | 0.67 | 0.67 | 0.67 | 0.33 |
| Polyacrylamide % | 0.038 | 0.019 | 0.0 | 0.0 | 0.019 |
| Head box paper stock concentration $g.l^{-1}$ | 3.6 | 3.6 | 3.6 | 3.6 | 3.6 |
| First pass retention all solids % | 97.9 | 92.9 | 88.8 | 89.7 | 91.7 |
| First pass retention calcium carbonate % | 95.9 | 83.6 | 75.4 | 76.3 | 88.3 |
| Ashes at 425° C. % | 22.3 | 21.8 | 21.7 | 21.8 | 22.0 |
| Zeta potential white waters | +11.1 | +1.1 | — | +0.7 | — |
| Felt + Wire/2 Cobb 60" (50% RH, 23° C.) | 20 | 22 | 23 | 23 | 20 |
| Grammage $g.m^2$ | 80 | 80 | 80 | 80 | 80 |

Here again the Cobb 60" shows that the paper is properly sized and has a commercially acceptable hydrophobicity for writing and printing.

We claim:

1. A process for paper stock comprising:

(a) forming a cellulose water slurry;

(b) preheating an alkenyl succinic anhydride, either in neat or in solution, to a temperature of about 30° C. to 60° C. and mixing said alkenyl succinic anhydride with water, said mixture being non-emulsified;

(c) injecting said mixture as a liquid jet with a piston pump through a nozzle, in droplet form, into said cellulose water slurry, before the formation of a dry paper web, said piston pump generating a pressure of about 50 atmospheres to about 300 atmospheres, said pressure sufficiently great to create a pressure differential between said size and said paper stock, said differential accelerating disintegration of the liquid jet and increasing contact between the size and paper stock, said increased contact accelerating the formation of a paper web from said cellulose/water slurry; and (d) drying said paper web;

wherein at least one of the cellulose water slurry and mixture contains a cationizing compound.

2. A process according to claim 1 in which the water with which the size is mixed is heated to between 30° C. to 60° C.

3. A process according to claim 1 or claim 2 in which the size is injected together with water in the concentration range 0.1–1.0 wt % on cellulose before the formation of a dry paper web.

4. A process according to claim 1 in which the water with which the size is mixed also contains a product to encapsulate the size.

5. The process of claim 1 wherein said piston pump generates a pressure of about 100–250 $kg/cm^2$.

6. The process of claim 5 wherein said size is mixed in a solution containing gas and said piston operates at about 50–300 atmospheres.

7. The process of claim 5 wherein said size is dissolved in an anhydrous aprotic water-soluble inert solvent.

8. A process for pumping size into paper stock comprising:

(a) forming a cellulose water slurry;

(b) preheating an alkyl ketene dimer, either in neat or in solution, above the melting point of said dimer, said melting point being 40° C., and mixing the preheated dimer with water, said dimer and said water being a non-emulsified mixture;

(c) injecting said mixture as a liquid jet with a piston pump through a nozzle, in droplet form, into said cellulose water slurry, before the formation of a dry paper web, the piston pump generating sufficiently great pressure of about 50 atmospheres to about 300 atmospheres, to create a pressure differential between said size and said paper stock, that accelerates disintegration of the liquid jet and increases contact between the size and paper stock, said increased contact accelerating the formation of a paper web; wherein the cellulose water slurry and/or size is treated with a cationizing compound; and (d) drying said paper web.

9. The process of claim 8 wherein said dimer is mixed in a solution containing gas and said piston pump operates at a pressure of about 50–300 atmospheres.

10. The process of claim 8 wherein said size is dissolved in an anhydrous aprotic water-soluble inert solvent.

11. The process of claim 8 wherein the water with which the size is mixed is heated to between 30° to 60° C.

12. The process of claim 8 wherein the size is injected in water at a concentration range 0.1–1.0 wt % on dry cellulose before the formation of a dry paper web.

13. The process of claim 8 wherein the cationizing compound is injected together with the size/water mixture.

14. The process of claim 8 wherein the water with which the size is mixed further contains an encapsulant for the size.

15. A process for sizing a paper stock comprising the steps of:

(a) forming a cellulose water slurry;

(b) preheating a sizing agent, either in neat or in solution;

(c) mixing the preheated sizing agent with water to form a sizing mixture, said sizing mixture being non-emulsified;

(d) injecting said mixture as a liquid let by means of a piston pump through a nozzle, in droplet form, into said cellulose/water slurry, before the formation of a dry paper web, (d) drying said paper web;

wherein said sizing mixture is injected at a sufficiently great pressure of about 50 atmospheres to about 300 atmospheres; said pressure sufficiently great to generate a pressure differential between said mixture and said paper stock, that accelerates disintegration of the liquid jet and increases contact between the size and paper stock, said increased contact accelerating the formation of said paper web and wherein at least one of said cellulose/water slurry and said sizing mixture contains a cationizing compound.

16. The process of claim 15 wherein said size comprises a succinic anhydride, said temperature is about 35°–50° C., and said pressure is about 100–250 $kg/cm^2$.

17. The process of claim 15 wherein said size comprises an alkyl ketene dimer and said temperature is above about 40° C.

18. The process of claim 15 wherein said sizing mixture contains a gas and said piston pump operates to generate a pressure of about 50–300 atmospheres.

19. The process of claim 15 wherein said size is dissolved in an anhydrous aprotic water-soluble inert solvent.

20. The process of claim 15 in which the water with which the size is mixed is heated to between about 30°–60° C.

21. The process of claim 15 in which the size is injected with water and at a concentration of about 0.1–1.0 wt % based on the weight of dry cellulose in the slurry.

22. The process of claim 15 in which the cationizing compound is injected together with the sizing mixture.

23. The process of claim 15 in which the water with which the size is mixed further contains an encapsulant for the sizing agent.

24. An apparatus for the injection of size into paper stock in a paper machine comprising: an injector nozzle located at the wet end of said paper machine, a source of preheated size, a low pressure pump which feeds the pre-heated size to a metering pump which pressurizes the pre-heated size to a pressure of about 50 to about 300 atmospheres and which forces the pressurized size through the injector nozzle in the wet end of the machine and into a cellulose stock, said apparatus generating a sufficiently large pressure differential between the size and the paper stock to increase contact between the size and the paper stock.

25. An apparatus according to claim 24 in which the injector nozzle injects size into a stream of water which itself feeds into the cellulose stock.

26. An apparatus according to claim 24 in which the metering pump is controlled by the rate of paper production.

27. An apparatus according to claim 25 in which the metering pump is controlled by the rate of paper production.

28. The apparatus of claim 24, wherein the nozzle is immersed in the cellulose stock.

29. The apparatus of claim 24, wherein more than one nozzle is used.

* * * * *